United States Patent [19]

Seaver

[11] Patent Number: 4,807,906

[45] Date of Patent: Feb. 28, 1989

[54] COMPUTER PAPER BINDER

[76] Inventor: Sally Seaver, 8 Carville Ave., Lexington, Mass. 02173

[21] Appl. No.: 227,995

[22] Filed: Aug. 3, 1988

[51] Int. Cl.[4] ..... B42D 3/00; B42F 13/00; A47G 1/24; A47B 94/04

[52] U.S. Cl. ..... 281/45; 402/73; 248/456; 248/460

[58] Field of Search ..... 281/29, 31, 33, 45; 402/73, 76, 80 R; 206/44 B, 44 R, 45.2, 45.23, 45.4; 248/441.1, 456, 457, 458, 460, 461, 463; 190/16

[56] References Cited

U.S. PATENT DOCUMENTS

| | | | |
|---|---|---|---|
| 1,918,773 | 7/1933 | Morehouse | 402/73 |
| 2,549,306 | 4/1951 | Greene | 402/80 R |
| 2,554,569 | 5/1951 | Guinane et al. | 402/76 |
| 3,991,967 | 11/1976 | Sack | 248/456 |
| 4,116,413 | 9/1978 | Andersen | 248/460 |
| 4,213,520 | 7/1980 | Sarna et al. | 248/461 |
| 4,544,123 | 10/1985 | Peacock | 248/460 |
| 4,555,128 | 11/1985 | White et al. | 248/456 |
| 4,709,895 | 12/1987 | Mardak | 248/460 |

*Primary Examiner*—Frank T. Yost
*Assistant Examiner*—Paul M. Heyrana, Sr.
*Attorney, Agent, or Firm*—Gordon K. Anderson

[57] ABSTRACT

A binder and angular stand for computer printout which has a bottom base (20) of rigid material with a pair of retainers (22) each having a slot (24) therein. A top cover (26) includes a hinge in the form of a pin (34) that interfaces with the slot allowing the cover to rotate and expand outwardly within the limitations of the slot. A hinged diagonal support brace (36) is rotationally attached to the top cover angularly extending by its own weight to form a support for the cover allowing printout to be retained and supported in both the open and closed position. A second embodiment is identical to the preferred, except somewhat simpler in construction utilizing a single brace (36*a*) in place of hinged members (38), (40), (42), (44), (46), and (48).

14 Claims, 4 Drawing Sheets

2-3
36
28
26
28
30
32
22
52
50
20
2-3
52
30

26
48
46
36
44
42
40
38
20

52
28
28
52
30
30
48
26
46
36
44
42
40
38
20

26
36
32
22
20

26
32
30
24
30
20
22

26
22
30
32
20

26
48
36
38
42
46
20
24
40
44
22

10-11
62
36a
22a
26a
62
28a
58
24a
22a
60
20a
57
28a
58
56

26a
22a
24a
20a 58
58
26a
36a
22a
62
24a
26a
20a 22a
36a
56
62
22a
24a
20a
56

26a
24a
58
22a
58
26a
24a
22a
56

20a
20a 58
57
26a
36a
24a
22a
56
20a

COMPUTER PAPER BINDER

TECHNICAL FIELD

The present invention relates to binders for stacks of paper in general, and more specifically to a binder that also functions as a stand to contain and angularly support a stack of unburst computer printout paper.

BACKGROUND ART

Previously, many types of separate binders and stands have been used in endeavoring to provide an effective means to protect and handle a stack of computer printout paper, as well as to simultaneously accommodate the paper when opened to a particular place. Most prior art with this background employs rings to bind the papers together and various shapes and forms of covers to allow one of the covers to be retained in an angular position.

A search of the prior art did not disclose any patents that read directly on the claims of the instant invention, however, the following U.S. patents were considered related:

| U.S. Pat. No. | Inventor | Issue Date |
|---|---|---|
| 4,623,276 | Kinneir | Nov. 18, 1986 |
| 3,724,876 | Krikorian | Apr. 3, 1973 |
| 3,716,256 | Moore | Feb. 13, 1973 |
| 3,618,241 | Doty et al | Nov. 9, 1971 |
| 2,835,511 | Ericson | May 20, 1958 |

Kinneir teaches a portable lectern using conventional rings with a rigid base member shaped in such a way that a wall flange and lip create a separate angular base in conjunction with the binder that allows pages to be opened and lean against the angled base member. The support means are located on one side of one edge and becomes selectively removable from the binder or may be stored therein for transportation.

Krikorian employs a holding mechanism mounted on the back panel of one of the outer covers in the form of an easel. The member engages the ring wires and holds the cover to an outer limit of normal pivotal movement at an oblique angular relation. The other cover is free to swing into a back to back relationship. The back cover being horizontal and the easel support angular, allows the sheets to be freely turned on the wire rings to and fro in an inclined position.

Moore, on the other hand, uses a generally U-shaped element affixed to the interior of the backbone of a bound book with a foldable strip connected between the front cover and the element limiting opening movement over a preselected arc. Further, opening results in joint rotational movement with the front cover prevented from becoming coplanar reducing the amount of rotation of the pages as they are turned providing a relaxed and stable paging of the book.

Doty et al teaches a console mounted looseleaf binder having a plurality of horizontally arranged binders in evenly spaced horizontal rows such that looseleaf sheets are extended in flat orientation. A hinged top opens at a predetermined angular displacement controlled by a hinged stop allowing the pages to rest thereupon in the open position.

Ericson improves a display binder by the addition of a pair of stop arms that engage an elongated still plate flushing engaging a portion of the inner face of a back panel. This arrangement allows the flat back to rest on a horizontal surface with the front panel extended upwardly. The paper leafs or sheets are attached to the rings and are rotated upwardly and rest upon the vertical front panel in an open manner allowing pages to be opened and retain their position for reading.

DISCLOSURE OF THE INVENTION

Since the wide spread use of computers has overtaken almost every facet of business, a problem has arisen that has not been completely addressed. Computers print out a special type of paper that is folded continuously in a fan-like manner and perforated to be torn or burst into individual sheets. The computer paper, or data processing forms, in most cases, are processed in printers that require holes on each side to hold the paper while imprinting. The problem arises that the computer paper may be read in the stack as it is attached together and, yet, the folds are on either side requiring reading the printout from the end rather than having the connecting on one side, like a book. The classic method of attaching a stack of paper together is by binding a fold into a book or punching holes and attaching with rings, staples, or pins. An attempt to solve the problem has been made by using a two-piece binder with top or bottom loading, nylon cables, or metallic clips, penetrating the uppermost set of holes with the covers top and bottom. While this type of binder does confine the stack of paper, it is still extremely difficult to hold it open requiring both hands, or even a heavy weight to maintain this position.

It is, therefore, a primary object of the invention to hold computer printout together, confined within a top and bottom cover and, yet, have the capability of opening to any page without bending the paper, except at the fold. This is accomplished by having a pair of vertical retainers on a bottom base or cover maintaining the integrity of the stack with a hinged top cover that restrains the stack in like manner on the opposite end when closed and becomes a stand when open. This arrangement does not grip the printout at all, instead, it retains it on the edges and the hinged cover simply folds back and is supported at an angle, thereby completely eliminating the need for two hands or trying to bend a large stack of paper to find the desired page. Further, as the printout is contained by folds on both edges, it is not like a stack of loose papers, instead, it maintains its shape and is easily handled when contained only on the edges.

An important object of the invention is directed toward the ability to view the entire page since it is not bound on an edge. When the binder is opened, the top cover is angled open and the stack is opened completely exposing both the top and bottom pages.

Another object of the invention is the ease in which the top cover is opened and supported at an angle. In both embodiments taught, the top cover is opened with one hand and the diagonal support folds outward by its own weight and is automatically locked in place, allowing a quick and ready reference when opening the binder for use.

Still another object of the invention provides organization for any convenient number of pages or height of the stack of computer printout paper, as the binder is adjustable in height and automatically compensates for thickness by relocating the top cover relative to the bottom base. With this arrangement no manual adjustment is required and as the stack is not permanently attached, the cover may be used by any number of stacks by simply placing it inside when in use and replacement by others when desired.

Yet another object of the invention allows the printout to be read using a minimum of desk space, as the top cover is braced open at an angle not actually touching the desk at all, minimizing the area required. The invention also keeps the stack neat while protecting the edges and is completely flat, unlike ring binders, for storing a number of binders together in a vertical stack.

A final object of the invention provides a flat, easy to write on surface for both the horizontal pages and those opened angularly. A place finder may be utilized consisting of a flat straight edge with a resistant surface on the side next to the paper to hold ones place when reading a line of printed indica.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred and a second embodiment. Both embodiments are primarily designed with the same basic elements, except the second embodiment is slightly simpler in construction.

Figures 1, 2, 3, 4, 5, 6, 7:
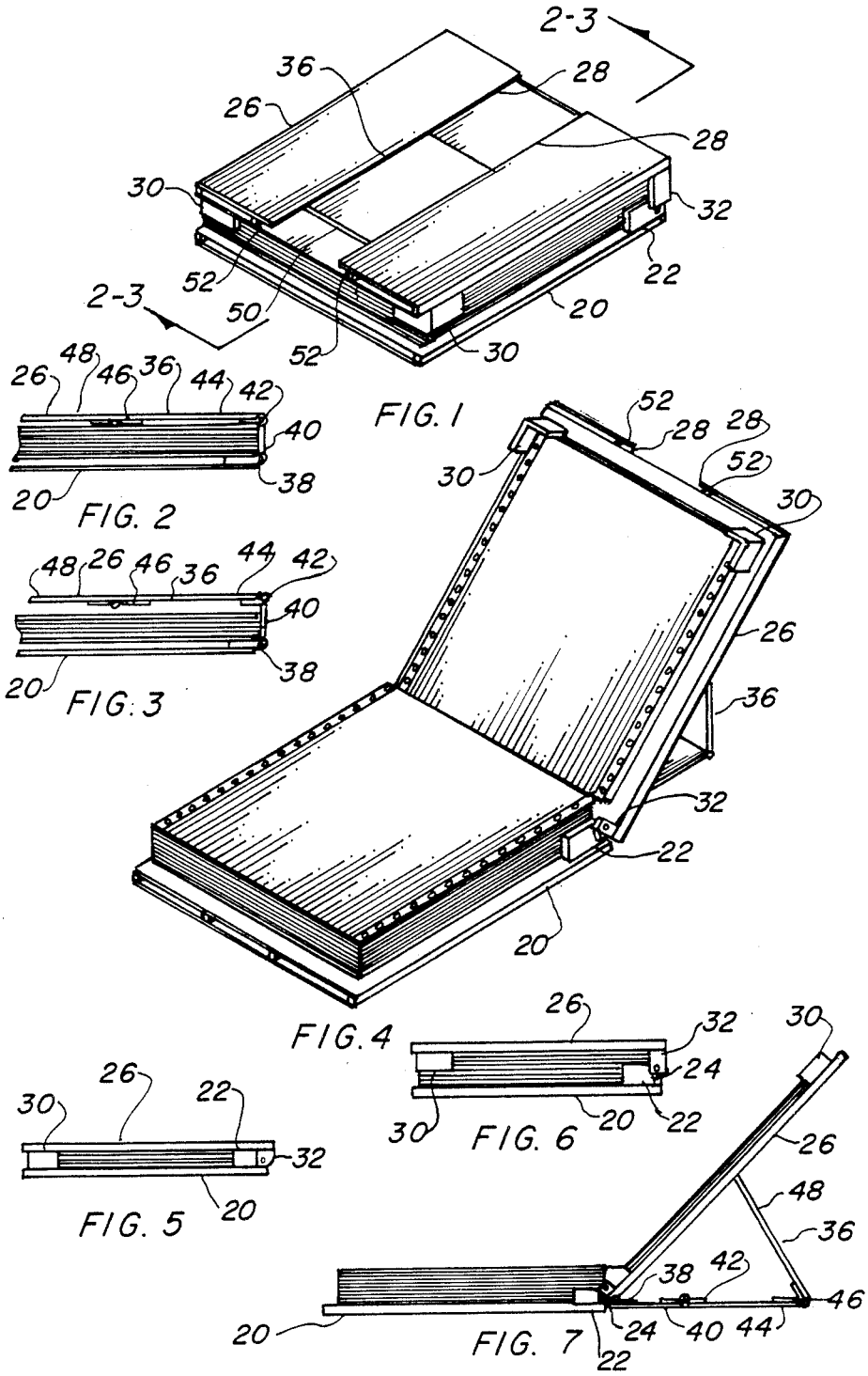
FIG. 1 is a partial isometric view of the preferred embodiment shown in the closed position with a stack of computer printout paper in place.
FIG. 2 is a cross-sectional view taken along lines 2—2 of FIG. 1 illustrating the diagonal support folded closed in the maximum stack height position.
FIG. 3 is a cross-sectional view taken along lines 3—3 of FIG. 1 illustrating the diagonal support folded closed in the minimum stack height position.
FIG. 4 is a partial isometric view of the preferred embodiment illustrated in the open position with a stack of computer printout paper in place.
FIG. 5 is a side elevation view of the preferred embodiment with the maximum stack of paper in place.
FIG. 6 is a side elevation view of the preferred embodiment with the minimum stack of paper in place.
FIG. 7 is a side elevation view of the preferred embodiment shown in the open position.
Figure 8:
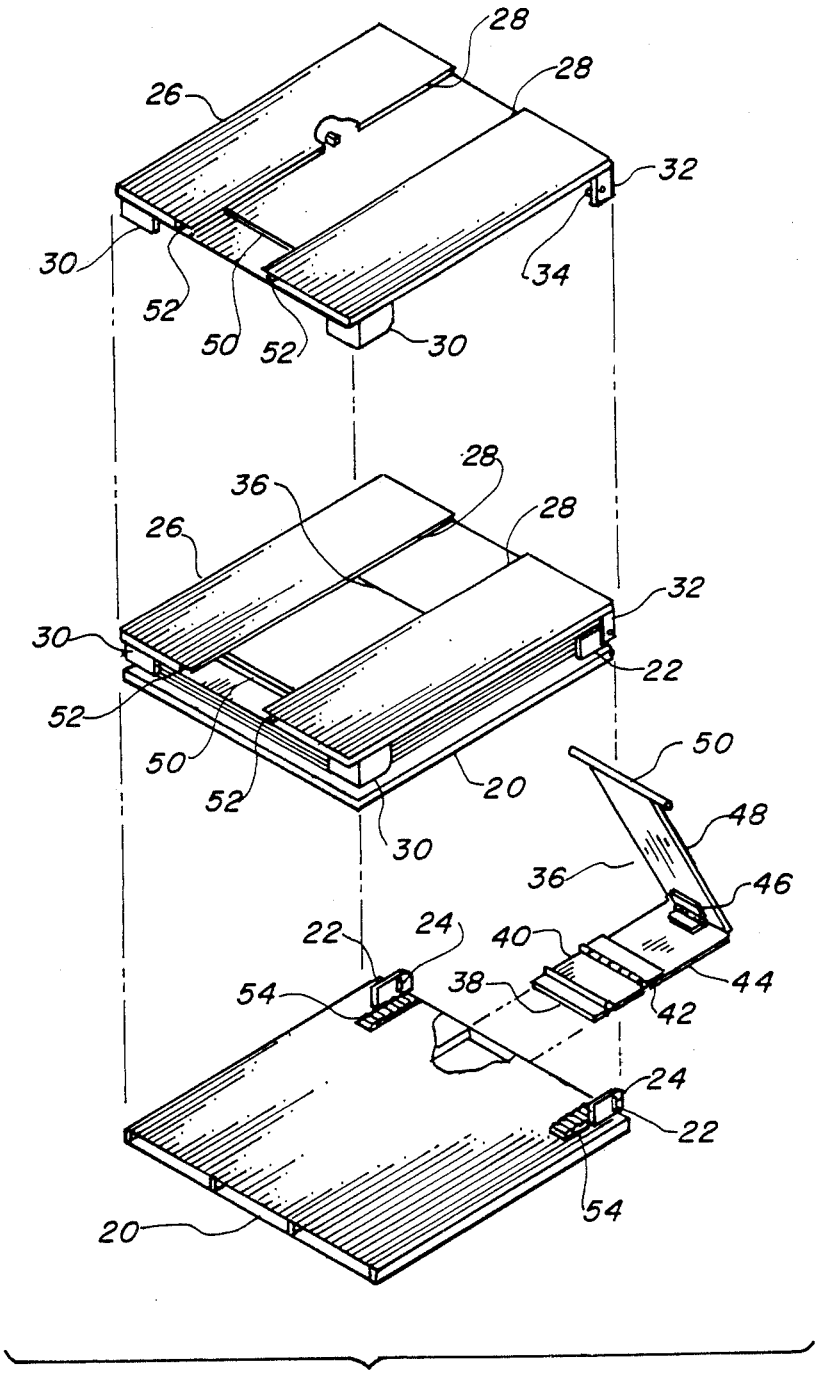
FIG. 8 is an exploded view of the preferred embodiment.

The preferred embodiment, as shown in FIGS. 1 through 8 is comprised of a bottom base 20 or cover of a rigid material having sufficient structural integrity to cover and partially enclose an unburst computer printout stack. This base 20 may be of any material suitable for the application, such as wood, metal, composition board, fabric covered cardboard, and the like, with thermoplastic being preferred in single or multiple layers. The thermoplastic may be polyvinyl chloride, polycarbonate, cellulose, polystyrene, polypropylene, polyester, etc.

A pair of vertical retainers 22 extend outward from the top surface of the base 20 and are either integral with or connected thereunto. Each retainer 22 contains a perpendicular slot 24 near the outside edge and the retainers are so configured as to contiguously engage and constrain a computer printout stack therebetween, as one retainer is located on each side of the stack. The retainers 22 are oblong and longitudinally parallel with the edge of the base 20 and are sufficiently high to act as a barrier for any height stack.

A top cover 26 is positioned on top of the computer printout stack directly in line with the bottom base 20. This cover 26 has a parallel center portion with raised sides 28 and acts as a protective shield and also as a stand when rotated open. The top cover 26 further contains a pair of angular stops 30 located near corners of each side opposite the vertical retainers 22 on the base cover 20. These stops 30 function in the same manner as the retainers 22, except they are on the top cover, instead of the base.

The cover 26 contains hinge means in the form of a pair of downwardly depending brackets 32 with inwardly projecting pivot pins 34. The brackets 32 are contiguous with the retainers 22 and the pins 34 slidingly interface with the slots 24 in the retainers, thereby captivating the cover 26 attaching it to the base in a rotatable manner and allowing expansion or retraction therebetween. The cover 26 rotates at least 160 degrees from a closed position in the preferred embodiment limited by the position of the slots 24 and pins 34 relative to the retainers 22 and brackets 32.

A hinged diagonal support brace 36 is pivotally joined to the top cover 26 creating a structural stand between the top cover 26 and the surface upon which the binder is positioned. The brace 36, as shown removed from the invention in FIG. 8, consists of a first hinge 38 that is attached permanently to the bottom base 20 allowing axial rotation and a first horizontal member 40 extending the support brace and also allowing rotation thereof. A second hinge 42 is attached to the first horizontal member 40 allowing compensation for the thickness of the computer printout with a second horizontal member 44 attached to the second hinge 42 providing adequate length for the brace to angularly support the cover. A third hinge 46 is attached to the second horizontal member 44 allowing the support brace 36 to bend, creating the proper functional angle for the top cover 26. A diagonal member 48 is attached to the third hinge 46 on one end with the other end contiguously engaging the top cover 26 providing a compression diagonal truss for transmitting the weight of the printout to the surface upon which the brace is resting securely holding the cover 26 open.

Means to retain the diagonal brace in an angular position consists of a spindle 50 on the outermost edge of the hinged diagonal support brace wider than the brace itself. Further, the top cover 26 contains an overhanging lip 52 within the parallel center portion 28. The spindle 50 is contained within the lip 52, thereby supporting the brace 36 in a slideable manner. When the top cover 26 is opened the brace 36 slides downward and outward by the hinge action, automatically unfolding the brace into the extended and angular position. The relation of the angle of the brace 36 and the binding action of the spindle 50 against the overhanging lips 52 lock the brace in place.

At least a pair of resilient bottom paper stack restraints 54 are attached to the bottom base 20 near the retainers 22 to prevent the computer printout from slipping when the majority of the paper is rotated upwards on the opened to cover 26. The restraints 54 consist of a resilient material, such as silicone mastic, that is formed with an irregular top surface that provides a gripping action to the printout stack. The restraint 54 is permanently bonded to the base 20.

Figures 9, 10, 11, 12, 13, 14, 15:
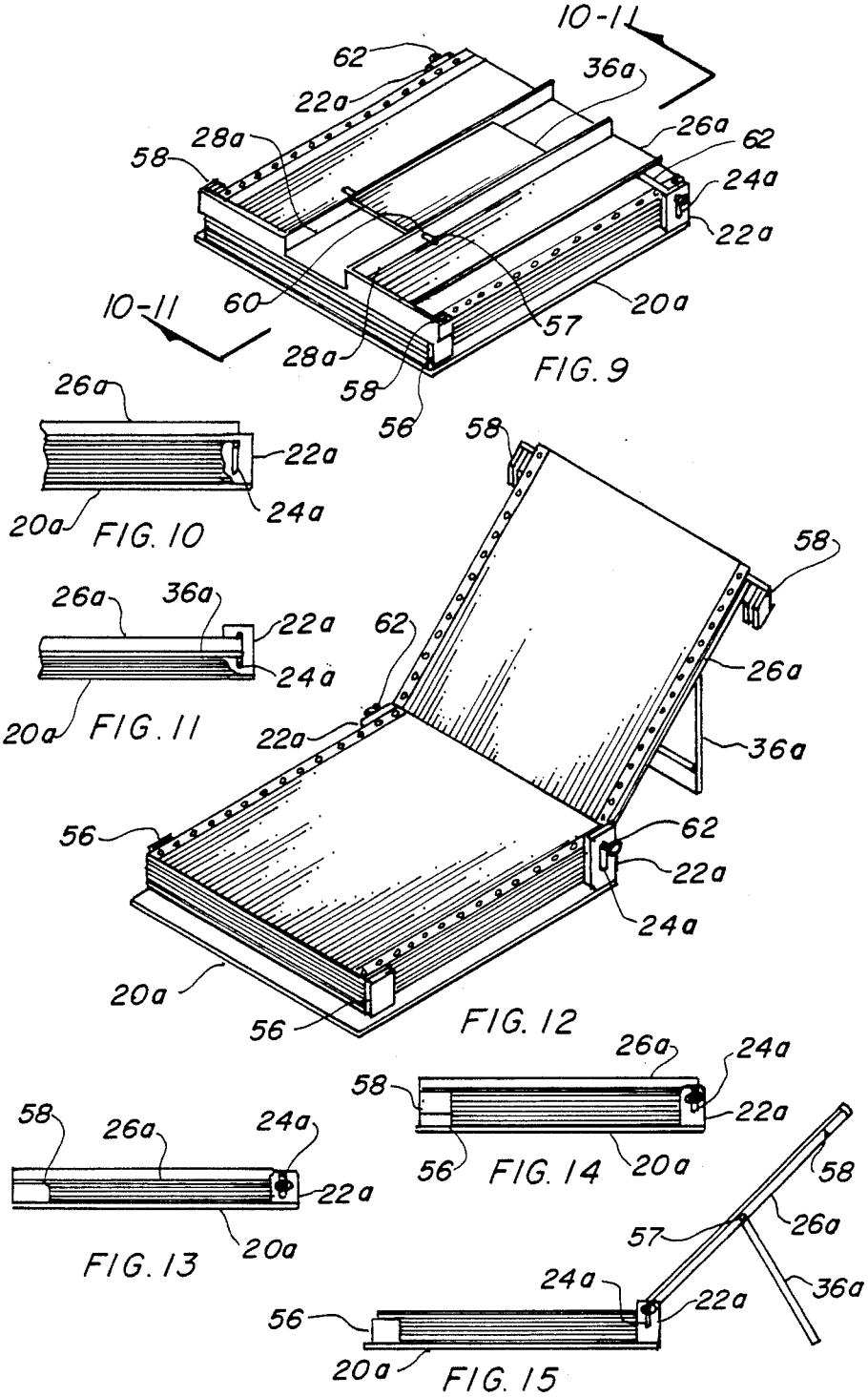
FIG. 9 is a partial isometric view of the second embodiment shown in the closed position with a stack of computer printout paper in place.
FIG. 10 is a cross-sectional view of the second embodiment taken along lines 10—10 of FIG. 9 illustrating the diagonal support folded closed in the minimum stack height position.
FIG. 11 is a cross-sectional view of the second embodiment taken along lines 11—11 of FIG. 9 illustrating the diagonal support folded closed in the maximum stack height position.
FIG. 12 is a partial isometric view of the second embodiment illustrated in the open position with a stack of computer printout paper in place.
FIG. 13 is a side elevation view of the second embodiment with the minimum stack of paper in place.
FIG. 14 is a side elevation view of the second embodiment with the maximum stack of paper in place.
FIG. 15 is a side elevation view of the second embodiment shown in the open position.
Figure 16:
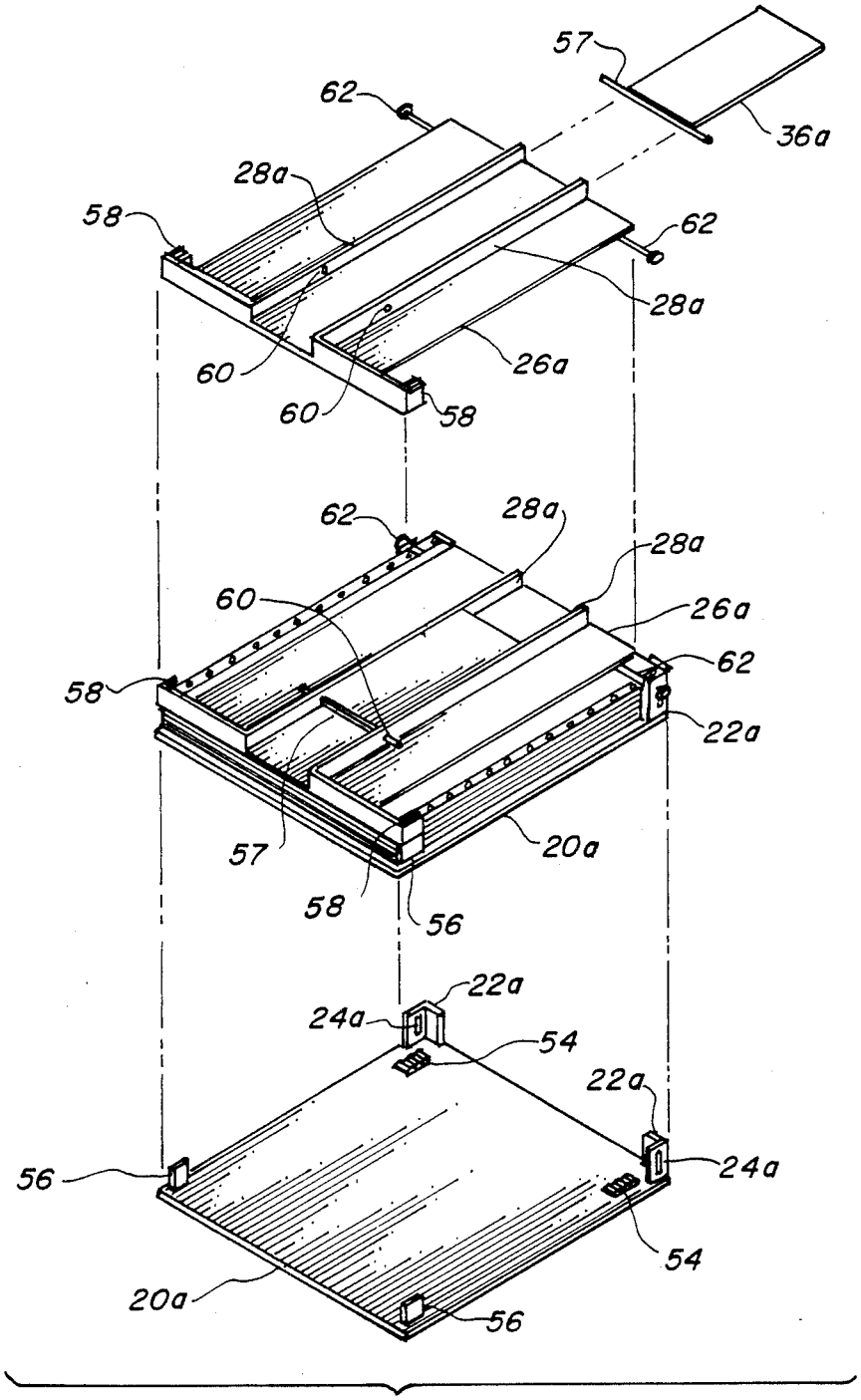
FIG. 16 is an exploded view of the second embodiment.

The second embodiment is illustrated in FIGS. 9 through 16 and is basically the same as the preferred embodiment, except simpler in construction. The bottom base **20*a* is the same, except it is a single thickness and the upstanding vertical retainers 22*a* are angular in form engaging both the sides and ends of the printout stack. The base 20*a* further contains a pair of integral side barriers 56 projecting upward from the corners opposite the retainers 22*a*. Interfacing with these barriers 56 are a pair of double downwardly distended support brackets 58 interfacing on each outside surface of the barriers 56 so as to interlock the top cover 26*a* onto the base 20*a* when closed. In this embodiment, the hinge means integral with the top cover is defined by a shaft 62 somewhat wider than the cover 26*a* that interfaces with the slots 24*a* in the retainers 22*a*** in a rotatable slideable manner.

The raised sides of the parallel center portion **28*a* of the top cover 26*a* contain a pair of opposed holes 60 for attachment of the diagonal support brace 36**.

The hinged diagonal support brace **36*a* consists of an extended integral hinge rod 57 positioned near the end of the brace 36*a* rotatably penetrating the holes 60 in the top cover 26*a* allowing the brace 36*a* to rotate within the confines of the center portion 28*a*. The binding action of the diagonal support brace 36*a* against the top cover 26*a* relative to the rod 62 in the hole 60 provide the retaining means to maintain the brace 36*a*** in a secure angular position.

The balance of the elements for the second embodiment are identical in function as that in the preferred embodiment.

In operation, either embodiment function the same, the only difference is that the top cover **26*a* is capable of opening a full 180 degrees in the second embodiment. In both configurations a stack of computer printout paper is placed in the binder of a thickness anywhere from a few sheets to a stack having a height equal to the expanded distance between the base 20, 20*a* and the cover 26, 26*a*. The retainers 22, 22*a*, stops 30, and barriers 56 hold the printout securely in place from the sides and the binder may be handled, stored, or stacked in a conventional book like manner. The binder may be placed on a flat surface and opened with the brace 36, 36*a* automatically folding outwardly to the predetermined angle and lock into place allowing the printout to be opened and the top portion rest upon the opened cover 26, 26*a***. In this position the printout is fully visible and easy to handle and either surface may be written upon easily and the information on a given line may be kept by the use of a flat straight edge with a resilient surface on the underside.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A computer printout paper binder and stand comprising:

(a) a bottom base of a rigid material having sufficient structural integrity to cover and partially enclose an unburst computer printout stack;

(b) a pair of upstanding vertical retainers each having a perpendicular slot therein integrally joined to said base in such a location as to constrain opposite sides of a stack of paper;

(c) a top cover having an inside and outside surface with the inside surface contiguous with a stack of computer printout paper and the outside having a parallel center portion with raised sides, the top cover providing a protective shield for the paper when closed and also an angular rest when rotated open acting as a stand to hold the paper in a divided position with part of the paper on the bottom and the remainder on the top cover;

(d) hinge means integral with said top cover pivotally interfacing said slot in each vertical retainer, rotatably joining the base and cover together such that the cover expands or retracts vertically within the limitations of the slots while freely rotating axially at least 160 degrees from a closed position when the cover is juxtapositioned upon the base;

(e) a hinged diagonal support brace pivotally joined to said top cover creating a structural stand supporting the top cover in an angular position away from the base allowing computer readout paper to rest on the inside surface; and, (f) means to retain said diagonal support brace in an angular position forming a rigid linear structure that limits the position of the support while in an open stand position and, yet, not impeding closing.

2. The paper binder and stand as recited in claim 1 wherein said upstanding vertical retainers are longitudinal and contiguous with a perforated edge of a stack of computer paper, one on each side, in parallel orientation.

3. The paper binder and stand as recited in claim 1 wherein said top cover further comprises a pair of angular paper stops, one on each side, opposite said hinge means positioned in such a manner as to restrain two edges of a stack of computer paper when the top cover is rotated downward upon the paper and closed thereupon.

4. The paper binder and stand as recited in claim 1 wherein said hinge means integral with said cover further comprise a pair of downwardly depending brackets with inwardly projecting pivot pins, said pins slidingly interfacing with said slots in said vertical retainers in a rotatable manner allowing the top cover to expand or retract while captivated therewith.

5. The paper binder and stand as recited in claim 1 wherein said hinged diagonal support brace further comprise, a first hinge attached to said bottom base for axial rotation and containment, a first horizontal member attached to said first hinge to extend the support brace and allow rotation thereof, a second hinge attached to said first horizontal member to provide rotation of the support means in order to compensate for the thickness of a stack of computer printout paper placed between the base and cover, a second horizontal member attached to said second hinge allowing adequate length for the brace to angularly support the cover in the open position, a third hinge attached to the second horizontal member allowing the support brace to bend angularly to create a functional angle for supporting the top cover, and, a diagonal member attached to the third hinge on one end and contiguous with the top cover on the other providing a compression diagonal truss for transmitting the weight from the opened top cover to a horizontal surface securely holding the cover open.

6. The paper binder and stand as recited in claim 1 wherein said means to retain said diagonal support brace in an angular position further comprise said top cover having an overhanging lip within said parallel center portion and said hinged diagonal support brace further having a spindle on an outermost edge wider than the overhanging lip creating a barrier that contains the diagonal support brace while allowing it to rotate and slide freely relative to the cover.

7. The paper binder and stand as recited in claim 1 further comprising a plurality of resilient bottom paper stack restraints attached to the bottom base near said upstanding vertical retainers in such a manner as to prevent computer printout from slipping when a majority of the printout paper is rotated upward onto the open top cover.

8. A computer printout paper binder and stand comprising:

(a) a bottom base of a rigid material having sufficient structural integrity to cover and partially enclose a stack of unburst computer printout paper, said base having a pair of resilient bottom paper stack restraints attached thereupon, each restraint positioned near opposed corners in such a manner as to prevent computer paper from slipping when a majority of the paper is rotated upward away from the stack;

(b) a pair of longitudinal upstanding vertical retainers each having a perpendicular slot therein integrally joined to said base in such a location as to constrain opposite sides of a stack of computer paper;

(c) a top cover having an inside and outside surface with the inside surface contiguous with a stack of computer paper and the outside having a parallel center portion with raised sides and a ridge therebetween, said top cover further having a pair of angular paper stops, one on each side positioned in such a manner as to restrain two edges of a stack of computer printout paper when the top cover is rotated downward upon the paper and closed thereupon. The top cover providing a protective shield for the paper when closed and also an angular rest when rotated angularly from said base acting as a stand to hold the paper in a divided position with part of the paper on the bottom and the remainder angled on the top cover;

(d) hinge means defining a pair of downwardly depending brackets with inwardly projecting pivot pins, said pins slidingly interfacing with said slots in said vertical retainer, rotatably joining the base and cover together such that the top cover expands or retracts vertically within the limitations of the slots while free to rotate axially at least 160 degrees from a closed position when the cover is juxtapositioned on the base;

(e) hinged diagonal support brace pivotally joined to said top cover creating a structure supporting the top cover in an angular position away from the base allowing computer readout paper to rest on the inside surface, said top cover having an overhanging lip within said parallel center portion and said hinged diagonal support brace having a spindle on an outermost edge wider than the overhanging lip creating a barrier that contains the support stand while allowing it to rotate and slide freely relative to the cover; and, (f) means to retain said support brace in an angular position forming a rigid linear structure that limits the position of the support while in an open stand position and, yet, does not impeed collapsing during a binder position when contiguous with both sides of a stack of computer paper, said means to retain further having, a first hinge attached to said bottom base for axial rotation and containment, a first horizontal member attached to said first hinge to extend the support means and allow rotation thereof, a second hinge attached to said first horizontal member to provide rotation of the support means in order to compensate for the thickness of a stack of computer paper placed between the base and cover, a second horizontal member attached to said second hinge allowing adequate length for the support means to angularly support the cover in the open position, a third hinge attached to the second horizontal member allowing the support means to bend angularly to create a functional angle for supporting the top cover, and, a diagonal member attached to the third hinge on one end and contiguous with the top cover on the other providing a compression diagonal truss for transmitting the weight from the opened top cover to a horizontal surface securely holding the cover open.

9. The paper binder and stand as recited in claim 1 wherein said upstanding vertical retainers are in angular form contiguously engaging both sides and ends of a stack of computer printout paper.

10. The paper binder and stand as recited in claim 1 further comprising a pair of integral side barriers projecting from said base on corners opposite said upstanding vertical retainers for holding a stack of computer paper on opposed sides.

11. The paper binder and stand as recited in claim 10 wherein said top cover further comprises a pair of double downwardly distending support brackets positioned directly above and interfacing on an outside surface of each side barrier so as to interlock said top cover onto said base when juxtapositioned therewith.

12. The paper binder and stand as recited in claim 1 further comprising said raised sides of the center portion of the top cover having pair of opposed holes for attachment of said diagonal support brace.

13. The paper binder and stand as recited in claim 12 wherein said hinged diagonal support brace further comprises an extended integral hinge rod positioned near an end of said diagonal support brace rotatably penetrating said holes in the raised sides of the center portion of the top cover allowing the hinged diagonal support brace to rotate within the confines of the center portion, the binding action of the diagonal support brace against the top cover relative to the rod in the hole defining the means to retain the diagonal support brace in an angular position.

14. A computer printout paper binder and stand comprising:

(a) a bottom base of a rigid material having sufficient structural integrity to cover and partially enclose an underside of a stack of unburst computer printout paper, said base having a pair of side barriers projecting outwardly on opposed corners for holding paper therebetween;

(b) a pair of upstanding angular vertical retainers each having a perpendicular slot therein integrally joined to said base in such a location as to constrain opposite sides of a stack of computer printout;

(c) a top cover having an inside and outside surface with the inside surface contiguous with an upperside of a stack of computer printout and the outside having a parallel center portion with raised sides having a pair of opposed holes therewithin, the top cover providing a protective shield for the printout when closed and, also an angular rest when rotated angularly from said base acting as a stand to hold the paper in a divided position with part of the paper on the bottom and the remainder on the top cover;

(d) a pair of double downwardly distending support brackets positioned directly above and interfacing on an outside surface of each side barrier so as to interlock said top cover onto said base when juxtapositioned therewith;

(e) hinge means integral with said top cover pivotally interfacing said slot in each vertical retainer, rotatably joining the base and cover together such that the top cover expands or retracts vertically within the limitations of the slots while free to rotate axially at least 180 degrees from a closed position when the cover is juxtapositioned on the base;

(f) hinged diagonal support brace pivotally joined to said top cover creating a structural brace supporting the top cover in an angular position away from the base allowing computer readout paper to rest on the inside surface; and, (g) means to retain said diagonal support in an angular position forming a rigid linear structure that limits the position of the support while in an open stand position and, yet, does not impeed collapsing during a binder position when contiguous with both sides of a stack of computer paper.

* * * * *